US006733204B1

(12) United States Patent
Paniccia

(10) Patent No.: US 6,733,204 B1
(45) Date of Patent: May 11, 2004

(54) VIEW SHIELD DEVICE

(76) Inventor: Ronald F. Paniccia, 29-10 166th St., Flushing, NY (US) 11358

( * ) Notice: Subject to any disclaimer, the term of this patent is extended or adjusted under 35 U.S.C. 154(b) by 0 days.

(21) Appl. No.: 10/213,143

(22) Filed: Aug. 7, 2002

(51) Int. Cl.[7] ..... E01F 15/02

(52) U.S. Cl. ..... 404/6; 404/9; 256/13.1; 256/24; 160/24; 160/238

(58) Field of Search ..... 404/6, 9; 256/1, 256/13.1, 24; 181/210; 160/239, 26, 31, 238, 24

(56) References Cited

U.S. PATENT DOCUMENTS 193,573 A * 7/1877 Tripp ..... 160/25
4,124,196 A * 11/1978 Hipskind ..... 256/1
5,015,119 A * 5/1991 Schmanski ..... 404/12
5,022,781 A * 6/1991 Smith ..... 404/6
5,186,438 A * 2/1993 Cross et al. ..... 256/13.1
5,611,641 A * 3/1997 Christensen ..... 404/6
5,718,414 A * 2/1998 Deloach et al. ..... 256/24
6,142,701 A * 11/2000 Falcon ..... 404/6
6,575,435 B1 * 6/2003 Kotzen ..... 256/24

* cited by examiner

*Primary Examiner*—Gary S. Hartmann

(57) ABSTRACT

A view shield device includes a plurality of shields each being removably extendable into one of a plurality of wells in a block such that the shields extend upwardly from the block. Each of the shields includes a housing that has a top wall, a bottom wall and a peripheral wall extending between the top and bottom walls. The peripheral wall has an elongated slot that extends therethrough. Attaching hooks attach the screen between a pair of spaced housings. The screen of a first of the shields may be extended between and attached to a second of the shields such that a passing motorist may not see between the housings of the first and second shields.

12 Claims, 5 Drawing Sheets

VIEW SHIELD DEVICE

BACKGROUND OF THE INVENTION

1. Field of the Invention

The present invention relates to shield devices and more particularly pertains to a new shield device for fulfilling a need for a shield for obstructing accident scenes on highways.

2. Description of the Prior Art

The use of shield devices is known in the prior art. U.S. Pat. No. 6,149,338 describes a highway barrier. Another type of shield device is U.S. Pat. No. 6,036,249 having a accident shield device for blocking views of accidents, stalled cars and the like. U.S. Pat. No. 4,124,196 describes a portable device for screening off an accident scene from view. Other related patents are U.S. Pat. No. 5,611,641, U.S. Pat. No. Des. 431,657, and U.S. Pat. No. 4,138,095.

SUMMARY OF THE INVENTION

An object of the present invention is to provide a new shield device that would be easy to use, be of retractable design, promote safety, and avoid traffic congestion.

Still another object of the present invention is to provide a new shield device that would allow police and emergency medical services to concentrate their efforts so assistance can be rendered to those involved in the original mishap.

To this end, the present invention generally comprises at least one block that has a bottom surface, an upper surface, a pair of sidewalls and a pair of end walls. The upper surface has a plurality of wells that extend therein. The walls are spaced from each other. The wells are generally aligned between the end walls. Each of the plurality of shields is removably extendable into one of the wells such that the shields extend upwardly from the block. Each of the shields includes a housing that has a top wall, a bottom wall and a peripheral wall extending between the top and bottom walls. The peripheral wall has an elongated slot that extends therethrough. A screen is retractably positioned in the housing. An attaching means is for selectively attaching the screen between a pair of spaced housings. The screen of a first of the shields may be extended between and attached to a second of the shields such that a passing motorist may not see between the housings of the first and second shields.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
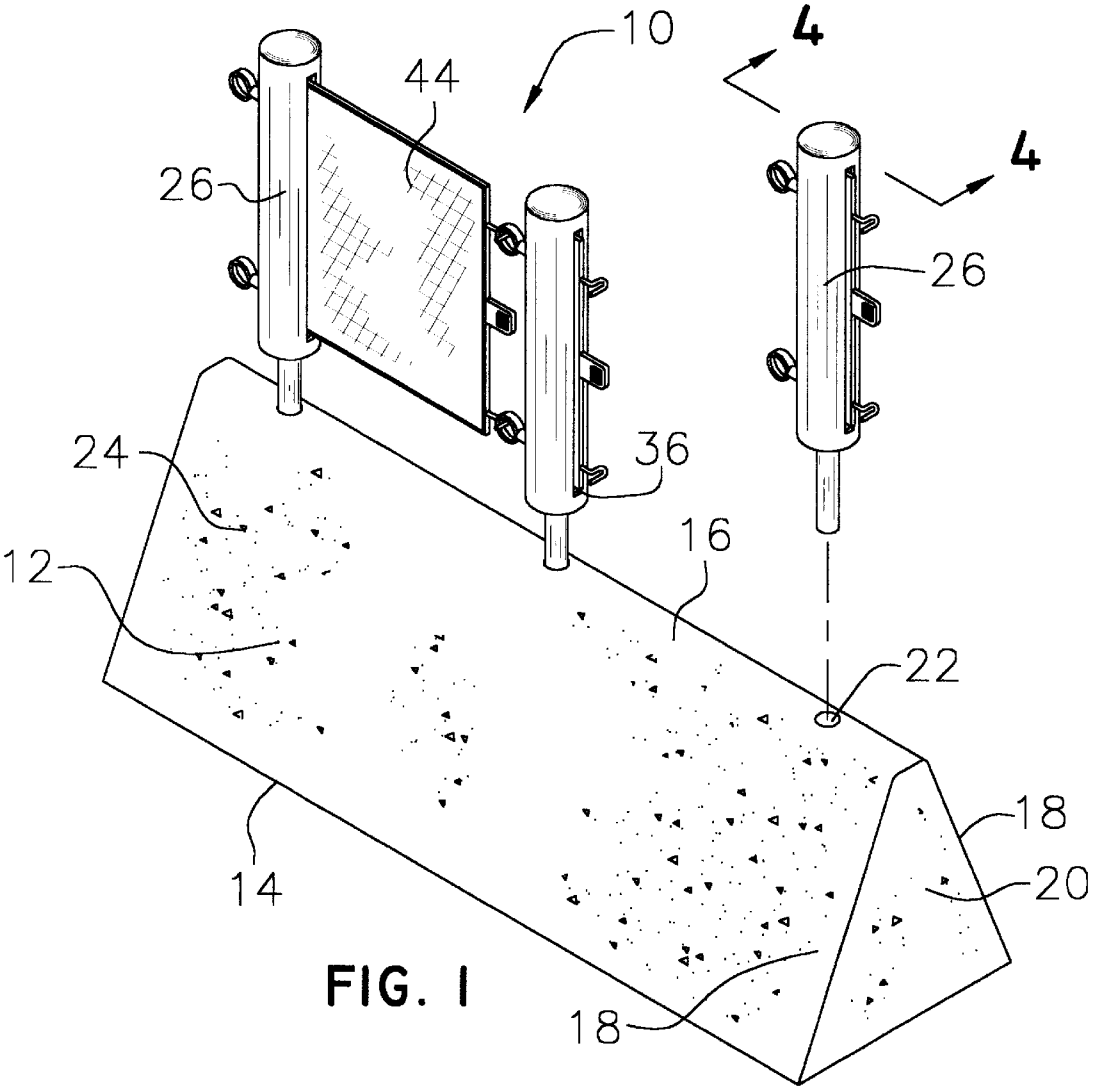
FIG. 1 is a perspective view of a view shield device according to the present invention.
Figure 2:
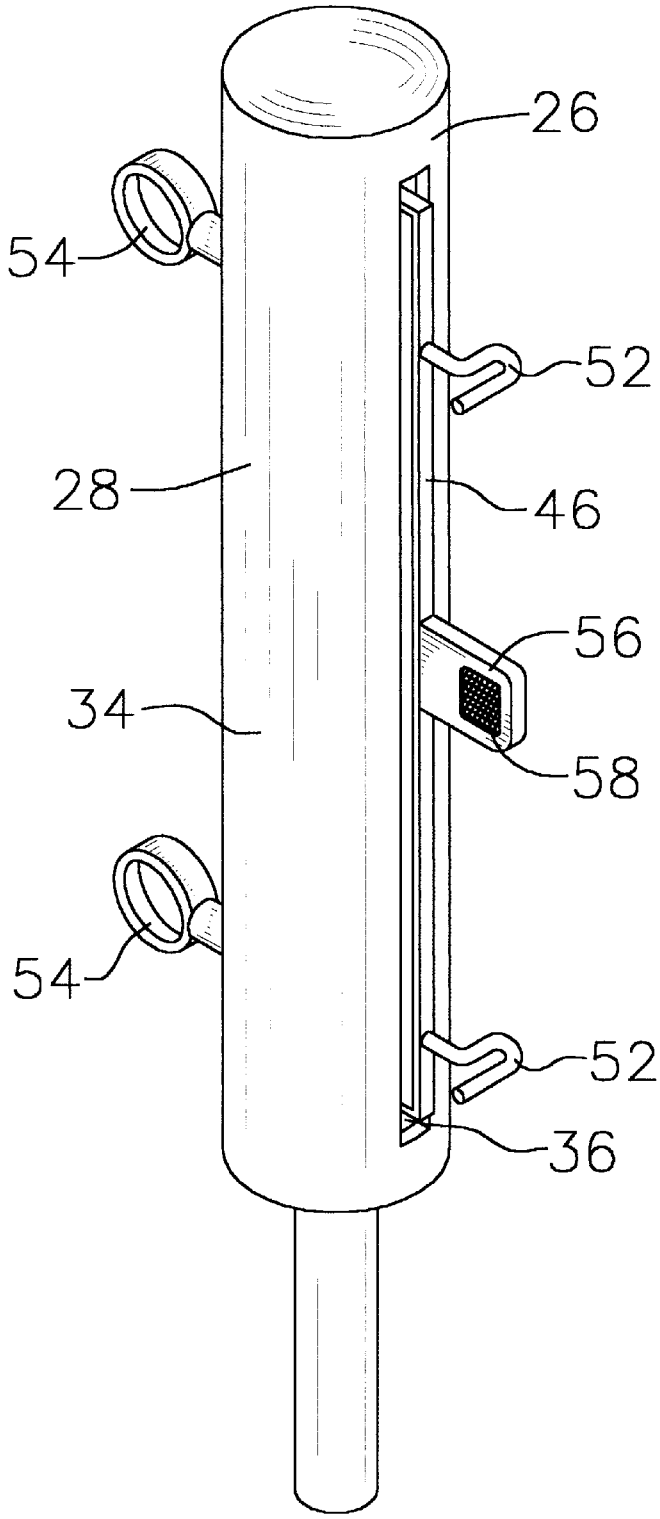
FIG. 2 is a perspective view of the present invention.
Figure 3:
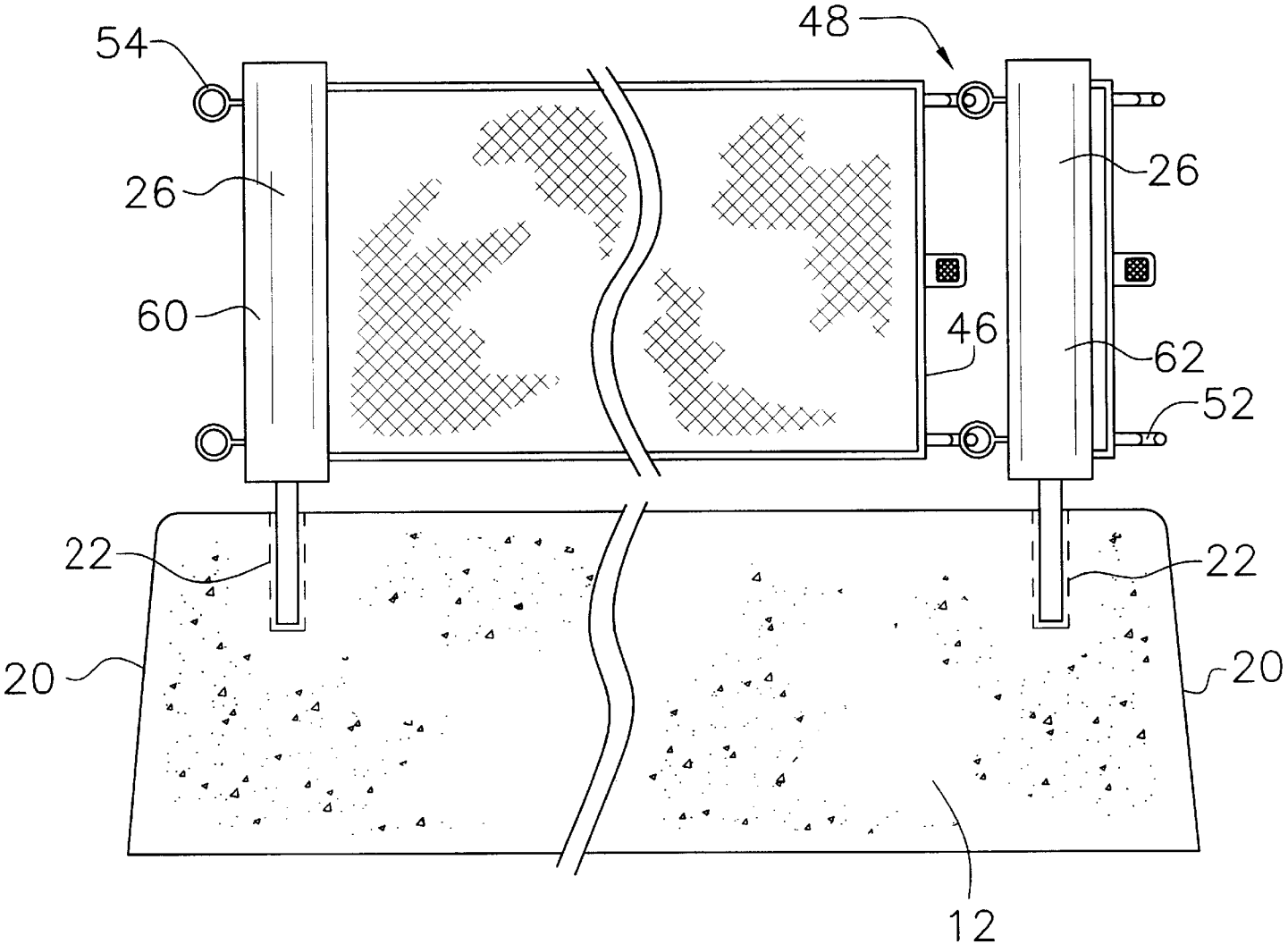
FIG. 3 is a front view of the present invention.
Figure 4:
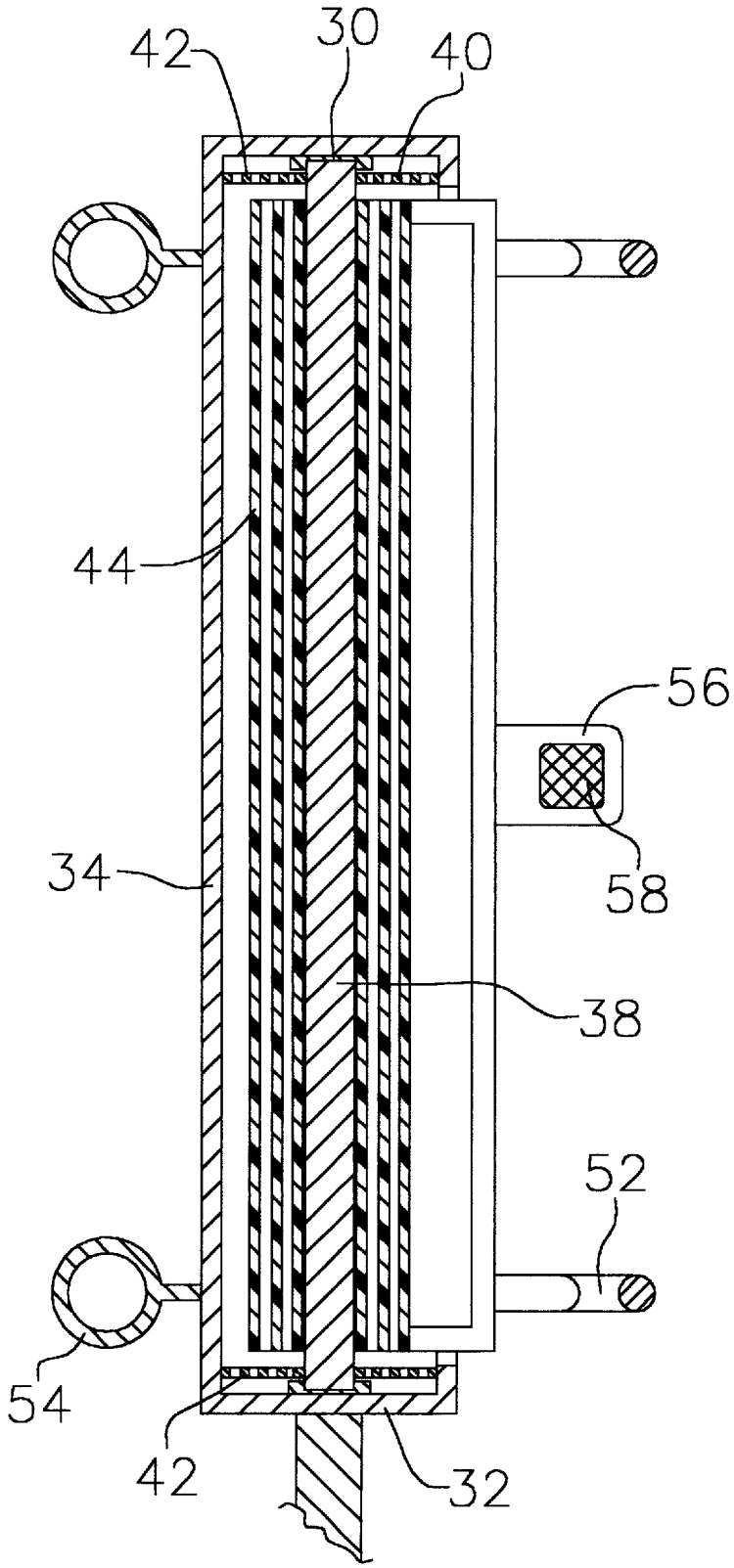
FIG. 4 is a cross-sectional view taken along line 4—4 of FIG. 1 of the present invention.
Figure 5:
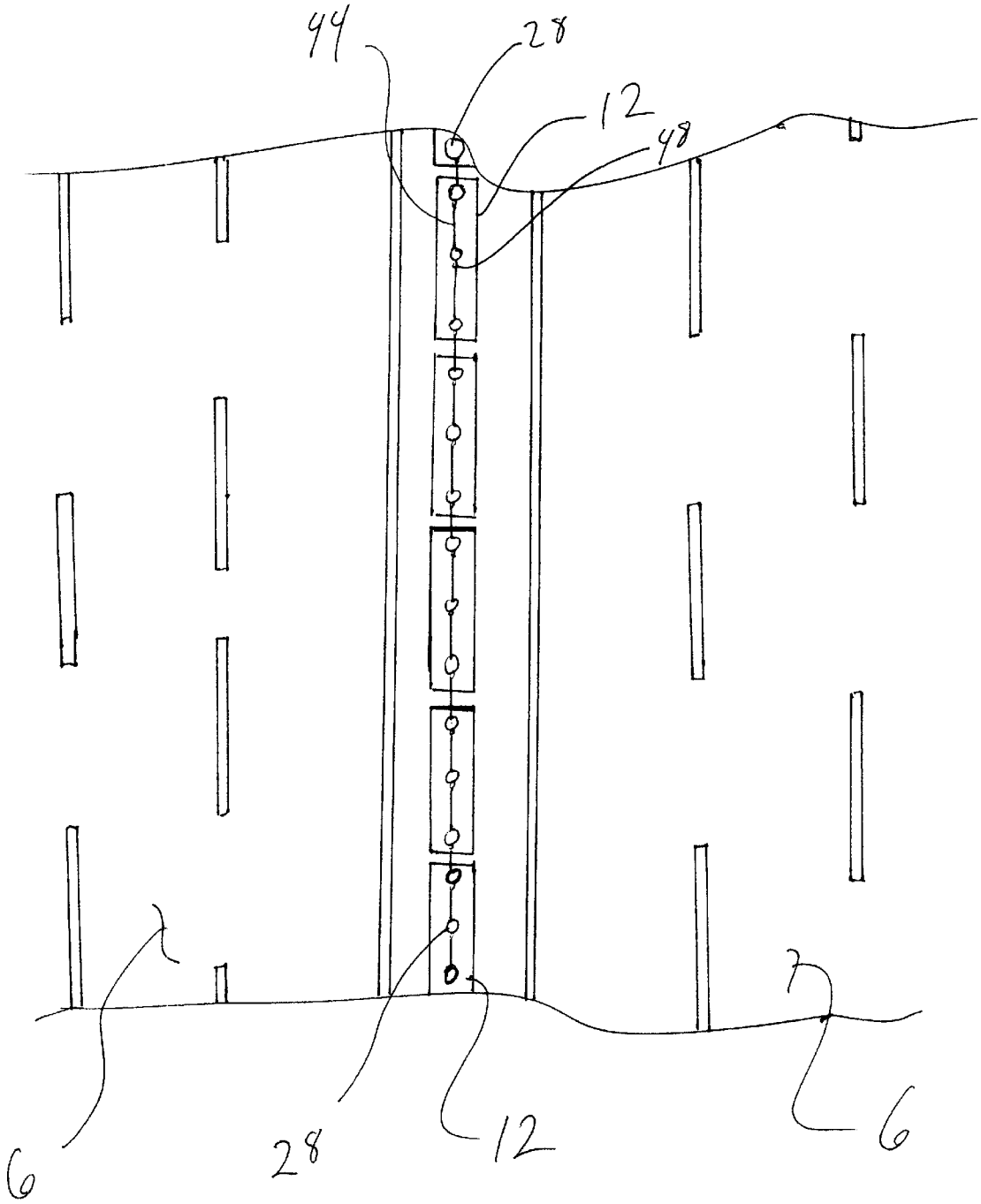
FIG. 5 is a top in-use view of the present invention.

With reference now to the drawings, and in particular to FIGS. 1 through 5 thereof, a new shield device embodying the principles and concepts of the present invention and generally designated by the reference numeral 10 will be described.

As best illustrated in FIGS. 1 through 5, the view shield device 10 generally comprises a view shield device 10 for preventing viewing across a roadway 6 by motorists. The device includes at least one block 12, a bottom surface 14, an upper surface 16, a pair of sidewalls 18 and a pair of end walls 20. The upper surface 16 has a plurality of wells 22 that extend therein. The wells 22 are spaced from each other. The wells 22 are generally aligned between the end walls 20. The block 12 preferably comprises a concrete material 24. The block 12 is positioned on the roadway.

Each of a plurality of shields 26 is removably extendable into one of the wells 22 such that the shields 26 extend upwardly from the block 12. Each of the shields 26 includes a housing 28, a top wall 30, a bottom wall 32 and a peripheral wall 34 that extends between the top 30 and bottom 32 walls. The peripheral wall 34 has an elongated slot 36 that extends therethrough. The slot 36 generally extends between the top 30 and bottom 32 walls.

A spindle 38 is rotatably positioned in the housing 28 and extends between the top 30 and bottom 32 walls. A biasing means 40 is attached to the spindle 38 for biasing rotation of the spindle 38 in a first direction. The biasing means 40 comprises a pair of coil springs 42. A screen 44 is attached to the spindle 38. The screen 44 and a free edge 46 that extends through the slot 36. Wherein the screen 44 is wound about the spindle 38 when the spindle 38 is rotated in the first direction. The screen 44 comprises a non-transparent flexible material.

An attaching means 48 is for selectively attaching the screen 44 between a pair of spaced housings. The attaching means 48 includes a pair of hooks 52 attached to the free edge 46 of the screen 44. The hooks 52 are spaced from each other. A pair of loops 54 is attached to an outer surface of the peripheral wall 34. The loops 54 are spaced from each other and are positioned generally opposite of the slot 36.

A handle 56 is attached to the free edge 46 and is positioned between the hooks 52. The handle 56 comprises a tab 58. The screen 44 of a first of the shields 60 may be extended between and are attached to a second of the shields 62 such that a passing motorist may not see between the housings 50 of the first 60 and second 62 shields.

In use, the block 12 is typically installed along a highway within along the divider. The shields 26 would resemble a series of upright posts positioned in the block 12 (or highway divider) on a continual basis, or could be carried by emergency workers and inserted into the wells 22 after an accident has occurred. If a serious accident or some other mishap occurs which would cause motorist distraction, the emergency personnel on the scene could extend the screens 44 for connection between shields 26.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A view shield device for preventing viewing across a roadway by motorists, said device including:

at least one block having a bottom surface, an upper surface, a pair of side walls and a pair of end walls, said upper surface having a plurality of wells extending therein, said wells being spaced from each other, said wells being generally aligned between said end walls;

a plurality of shields, each of said shields being removably extendable into one of said wells such that said shields extend upwardly from said block, each of said shields including;

a housing having a top wall, a bottom wall and a peripheral wall extending between said top and bottom walls, said peripheral wall having an elongated slot extending therethrough;

a screen being retractably positioned in said housing, said screen having a free edge extending through said slot;

an attaching means for selectively attaching said screen between a pair of spaced housings, said attaching means includes a pair of hooks attached to a free edge of said screen, said hooks being spaced from each other, a pair of loops being attached to an outer surface of said peripheral wall;

a handle being attached to said free edge and being positioned between said hooks, said handle including a tab for selectively gripping said handle, and wherein the screen of a first of said shields may be extended between and attached to a second of said shields such that a passing motorist may not see between the housings of the first and second shields.

2. The view shield device in claim 1, wherein said screen comprising a non-transparent flexible material.

3. The view shield device in claim 1, wherein each of said shields further includes:

a spindle being rotatably positioned in said housing and extending between said top and bottom walls;

said screen being attached to said spindle, wherein said screen is wound about said spindle when said spindle is rotated in a first direction.

4. The view shield device in claim 3, wherein each of said shields further includes biasing means being attached to said spindle for biasing rotation of said spindle in said first direction.

5. The view shield device in claim 4, wherein said biasing means comprises a pair of coil springs.

6. The view shield device in claim 1, wherein said loops are spaced from each other and being positioned generally opposite of said slot.

7. A view shield device for preventing viewing across a roadway by motorists, said device including:

at least one block having a bottom surface, an upper surface, a pair of side walls and a pair of end walls, said upper surface having a plurality of wells extending therein, said wells being spaced from each other, said wells being generally aligned between said end walls, said block comprising a concrete material, said block being positioned on the roadway;

a plurality of shields, each of said shields being removably extendable into one of said wells such that said shields extend upwardly from said block, each of said shields including;

a housing having a top wall, a bottom wall and a peripheral wall extending between said top and bottom walls, said peripheral wall having an elongated slot extending therethrough, said slot generally extending between said top and bottom walls;

a spindle being rotatably positioned in said housing and extending between said top and bottom walls;

a biasing means being attached to said spindle for biasing rotation of said spindle in a first direction, said biasing means comprising a pair of coil springs;

a screen being attached to said spindle, said screen having a free edge extending through said slot, wherein said screen is wound about said spindle when said spindle is rotated in said first direction, said screen comprising a non-transparent flexible material;

an attaching means for selectively attaching said screen between a pair of spaced housings, said attaching means including a pair of hooks attached to said free edge of said screen, said hooks being spaced from each other, a pair of loops being attached to an outer surface of said peripheral wall, said loops being spaced from each other and being positioned generally opposite of said slot;

a handle being attached to said free edge and being positioned between said hooks, said handle comprising a tab; and wherein the screen of a first of said shields may be extended between and attached to a second of said shields such that a passing motorist may not see between the housings of the first and second shields.

8. A view shield device for preventing viewing across a roadway by motorists the shield device being removably extended into one of a plurality of wells in an upper surface of blocks dividing a roadway, said device including:

a plurality of shields, each of said shields being removably extendable into one of said wells such that said shields extend upwardly from said block, each of said shields including;

a housing having a top wall, a bottom wall and a peripheral wall extending between said top and bottom walls, said peripheral wall having an elongated slot extending therethrough;

a screen being retractably positioned in said housing, said screen having a free edge extending through said slot;

an attaching means for selectively attaching said screen between a pair of spaced housings, said attaching means includes a pair of hooks attached to a free edge of said screen, said hooks being spaced from each other, a pair of loops being attached to an outer surface of said peripheral wall;

a handle being attached to said free edge and being positioned between said hooks, said handle comprising a tab extending away from said free edge; and wherein the screen of a first of said shields may be extended between and attached to a second of said shields such that a passing motorist may not see between the housings of the first and second shields.

9. The view shield device in claim 8, wherein each of said shields further includes:

a spindle being rotatably positioned in said housing and extending between said top and bottom walls;

said screen being attached to said spindle, wherein said screen is wound about said spindle when said spindle is rotated in a first direction.

10. The view shield device in claim 9, wherein each of said shields further includes biasing means being attached to said spindle for biasing rotation of said spindle in said first direction.

11. The view shield device in claim 10, wherein said biasing means comprises a pair of coil springs.

12. The view shield device in claim 8, wherein said loops are spaced from each other and being positioned generally opposite of said slot.

* * * * *